US005285711A

United States Patent [19]

Sanderson

[11] Patent Number: 5,285,711

[45] Date of Patent: Feb. 15, 1994

[54] METHOD AND APPARATUS FOR TUNING MUSICAL INSTRUMENTS

[75] Inventor: Albert E. Sanderson, Carlisle, Mass.

[73] Assignee: Inventronics, Inc., Chelmsford, Mass.

[21] Appl. No.: 913,695

[22] Filed: Jul. 14, 1992

[51] Int. Cl.[5] ..... G10G 7/02

[52] U.S. Cl. ..... 84/454; 84/DIG. 18; 324/76.11

[58] Field of Search ..... 84/454, DIG. 18; 324/79 R, 81

[56] References Cited

U.S. PATENT DOCUMENTS

| | | | |
|---|---|---|---|
| 3,968,719 | 7/1976 | Sanderson | 84/454 |
| 4,018,124 | 4/1977 | Rosado | 84/454 |
| 4,142,434 | 3/1979 | Gross | 84/DIg. 18 X |
| 4,796,509 | 1/1989 | Mizuguchi et al. | 84/454 |
| 4,991,484 | 2/1991 | Kawaswima | 84/454 X |

*Primary Examiner*—Michael L. Gellner
*Assistant Examiner*—P. Stanzione
*Attorney, Agent, or Firm*—Pearson & Pearson

[57] ABSTRACT

A method and apparatus for tuning a musical instrument. Measurements are made of the inharmonicities of three notes (e.g., F3, A4 and C6 in a piano). One of the notes (e.g. A4) is a standard note that is to be tuned to a standard frequency. The measured inharmonicities of these notes determine a slope of a tuning curve and a position to intercept the standard note frequency according to the following:

$$Y(p,N) = \frac{15}{F^2 - 1}[B(N) - B(STD)] + (p^2 - 1)B(N)$$

Y(p,N) is the cents deviation relative to the equally tempered scale of partial p of note N, F is a factor by which the inharmonicity increases per octave taken from the measurement, B(N) is the inharmonicity of note N, and B(STD) is the inharmonicity factor of a standard note (e.g., A4 at 440 Hz).

6 Claims, 6 Drawing Sheets

METHOD AND APPARATUS FOR TUNING MUSICAL INSTRUMENTS

BACKGROUND OF THE INVENTION

Field of the Invention

This invention generally relates to tuning musical instruments and more specifically to a novel method and apparatus for tuning certain musical instruments.

Description of Related Art

Conventionally, a person tuning a musical instrument, such as a piano, listens to a reference note and adjusts the instrument until the pitch of another note seems consonant with the reference note. Consciously, or not, the person tunes a note for a specified beat rate, (which may be zero beat), with the reference note, usually at some harmonic of either one or both the notes.

This type of tuning is possible because an equally tempered scale is based upon simple mathematical relationships. In practice, however, pianos and other stringed instruments do not follow simple mathematical rules. In fact, piano tuners and builders use "harmonic" to denote a mathematical harmonic of a note and "partial" to denote the overtone which a string actually produces. The difference between a harmonic and a corresponding partial is caused by "inharmonicity" and is called "stretch". Stretch and inharmonicity can be significant. In a piano, for instance, the second partial from a string may average 2.002 to 2.006 or more times the fundamental frequency (i.e., the first partial). Thus, if the fundamental notes are tuned mathematically, stretch causes the piano to sound out of tune (i.e., to be inharmonious).

Therefore, pianos and similar instruments must be tuned differently. Historically, a piano tuner, for example, uses a complex, iterative aural process in which he tries to reduce errors to a minimum step-by-step. Basically, he starts tuning a piano in a "temperament octave" by adjusting a first or "standard" note to a standard frequency, usually provided by a tuning fork. Normally the "standard" note is A4 and the standard frequency is 440 Hz. He adjusts the remaining notes in the temperament octave by listening to partials of notes in third, fourth and fifth intervals. For example, in striking an interval of a third with a previously tuned lower note, the tuner adjusts the upper note while listening to the beat between the fifth partial of the lower note and the fourth partial of the upper note. He assumes the proper relationship exists when he hears a predetermined beat frequency.

Listening to these partials and beat frequencies reduces errors at the fundamental frequency because the partials multiply any error in terms of actual frequency differences. That is, a 4 Hz error at the fourth partial represents only a 1 Hz error at the fundamental. Also, the use of partials inherently tends to compensate for piano stretch. However, the process is not perfect because the tuner's beat rates are calculated from harmonics rather than partials, and the tuner usually checks the temperament octave by retuning it using different intervals to minimize the tuning errors.

Once the tuner completes the temperament octave, he tunes other notes by comparing partials of notes at octave intervals. He may, for example, listen to the beat between the fourth partial of a lower, tuned note and the second partial of the upper note while adjusting string tension for the upper note. Lower notes are tuned similarly, although not necessarily with octave intervals.

Each note in a piano is sounded by striking one, two or three strings. During the foregoing procedure, the tuner damps out strings so only one string actually sounds when a hammer strikes all the strings associated with that note. After the tuner completes the procedure, he must tune the other strings for each note by comparing either the fundamental or partial frequencies of two strings associated with a given note.

My previously issued U.S. Pat. No. 3,968,719 issued Jul. 13, 1976 for a Method for Tuning Musical Instruments, and assigned to the same assignee as the present invention, discloses a method for tuning a piano or other inharmonic musical instrument. In accordance with the disclosures in that patent, a tuner tunes a musical instrument such as a piano by the use of custom tuning curves or by octave tuning or temperament-octave mathematical tuning methods.

In accordance with the last method, it had been found that over a major portion of pianos, and particularly through the notes C3 through C8, a mathematical relationship existed that could be defined generally as:

$$B(N)=[B_0][2^{((N-N0)/K1)}] \quad (1)$$

In this relationship B(N) is an inharmonicity factor in cents for the fundamental or first partial of any note; $B_0$ is the measured inharmonicity for a reference note; N is a note number, which is an integer number assigned to each note in sequence from N=1 for A0 through N=88 for C8; $N_0$ is the note number for the reference note; and K1 is a slope factor which represents the number of notes over which the inharmonicity factor B(N) doubles.

Under this method, a piano could be tuned according to the following relationship:

$$Y(n,N)=B_0[(n^2+K_2)2^{(N-N0)/K1}-1-K_2] \quad (2)$$

In this relationship Y(n,N) is the deviation from the theoretical frequency of the "n"th partial of note N. $K_2$ is an octave matching factor.

That patent also describes a method by which each octave is stretched beyond normal. The formula for determining the deviation of any note or partial from a reference frequency for the equal temperament octave with such overstretch is:

$$Y'(n,N)=Y(n,N)+a[1-2^{(N0-N)/12}] \quad (3)$$

where Y'(n,N) is the deviation required for an overstretched octave and "a" is a constant for controlling the beat rate. A value a=1 provided a half-beat rate for $N_o$=49 (i.e., A4) using octave tuning.

As stated, the tunings according to this assumption provided generally satisfactory results. However, critical piano tuners prefer that a piano, when tuned, produces a smooth transition in beat frequencies over the entire range of the instrument. For example, if a major third at F3 and A3 produces a beat frequency of 7, the piano tuner may wish a beat frequency of 7.5 for the F#3 A#3 major third. Critical tuners are very sensitive to this transition and particularly to any discontinuity in the transition.

The prior tuning method introduced at least two detectable discontinuities that result because the assumption of a constant slope, as represented by equations (1), (2) and (3), does not always define a piano accurately. Stated differently, the assumption that an inharmonicity exists with a constant slope is only valid over a range of notes, for example, only about the middle five octaves of a piano. Notes outside those tuned with direct reference to the narrow range may produce partials that do not coincide with partials produced by notes in the range. This becomes evident when a double octave is played. The double octave has become an important interval for determining tuning quality.

It has been suggested that the inharmonicity at different positions on the piano be measured to produce separate tuning curves for specific ranges of notes. However, discontinuities will occur at each transition between adjacent curves. It also takes much longer to prepare the resulting tuning curves for a given piano and so will be less favorably received particularly by tuners who use tuning instruments.

When the measured inharmonicity of one note is the sole criteria for defining the inharmonicity for each note in a range, it becomes difficult to match the first partial of a note to a specific frequency. Historically piano tuners use the range F3 to F4 as a temperament octave, so F4 is selected to measure inharmonicity because it is the top note of the temperament octave and determines the stretch for the temperament octave. However, this requires an extrapolation to adjust the frequency of A4 to the 440 Hz standard frequency. This note must also be tuned to fit between other notes at other partials. After a musical instrument is tuned, the first partial, or fundamental, frequency of the standard note will be offset from the standard frequency, and will, therefore, be out of tune.

The prior method and apparatus tunes an instrument adequately for most individuals, but not for individuals who can detect the discontinuities in the change in beat frequencies across the range of the piano and any offset in the frequency of the standard note. This is due primarily to the fact that this prior art method does not provide a tuning curve for every note in the piano and because the basic tuning curves assume a constant slope between the inharmonicity of the note and the note number. It relies only on one measurement, namely the inharmonicity of one note.

SUMMARY

Therefore it is an object of this invention to provide a new method and apparatus for tuning a musical instrument that takes into account plural inharmonicity characteristics of a musical instrument.

Another object of this invention is to provide a tuning instrument that will determine, for each note on the piano, a tuning frequency based upon the inharmonicity of that piano and that will establish a frequency for a standard note that corresponds to a standard frequency.

Still another object of this invention is to provide a method and apparatus that enables a mechanical portable aid to be used in tuning a musical instrument.

In accordance with the apparatus and method of this invention, the inharmonicities of two or more notes are measured to obtain a measure of the change of inharmonicity over a range of notes in a musical instrument. This provides a basis for determining a specific tuning frequency for each note of the instrument. If one of the measurements is made using a standard note, the tuning frequency for the standard note will produce a fundamental partial tuned to the standard frequency. Additional inharmonicity measurements for other notes can be included to determine the change of inharmonicity more accurately.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
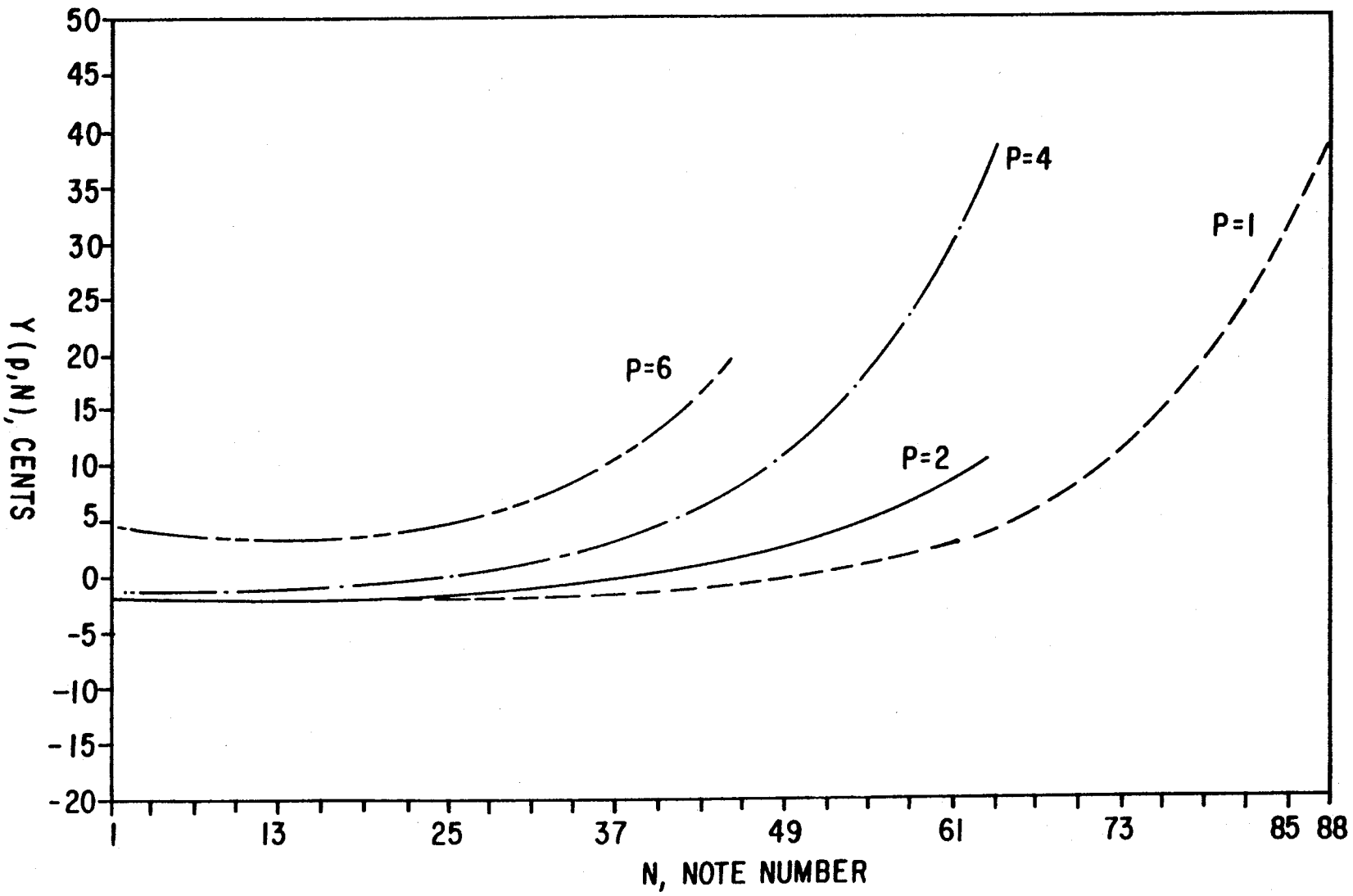
FIG. 1 is a graphical analysis that shows the results of using the tuning method and apparatus of this invention.

There are a wide variety of musical instruments that exhibit the characteristic of inharmonicity. The following discussion is limited to a piano as such a musical instrument, but only for the purpose of illustration. The method and apparatus of this invention are applicable to any musical instrument.

In the following discussion, notes A0 through C8 correspond to the piano keys from the lowest to the highest frequency and to note numbers N1 through N88. Normally the piano is tuned to some "standard" frequency such as 440 Hz. This phrase means that A4, or note N49, has a first partial frequency of 440 Hz. The term "cents" refers to a deviation of the measured frequency of a note and the mathematical or other reference frequency. A "cent" is defined as one percent of a semi-tone that, in turn, is about six percent of the base frequency of a given note. "Inharmonicity" is a difference between (1) the frequency of a high order partial from a given note and (2) the product of the frequency of a lower order partial and the ratio of the partial orders. For example, if the first partial of A4 is measured at 440 Hz and the fourth partial of A4 is measured at 1776 Hz, the inharmonicity, when expressed as percentage of the semitone is about 5.7 cents.

As previously indicated, equation (1) defines a straight line relationship that may exist over five or so octaves for a given piano. Although the straight line relationship exists with essentially all pianos, the slope of that straight line relationship varies from one piano to another. Consequently the prior art assumption of a constant slope by definition produces some tuning errors in tuning equations (2) and (3).

An analysis of different pianos also discloses that within a piano that the beat rates produced between a given order partial and a corresponding harmonic vary widely. For example, the sixth partial of notes in a particular piano may vary from about 1.4 or 1.5 beats sharp to over 38 beats flat between notes N1 and N57. An analysis with other intervals shows similar variations over wider and narrower ranges. The smallest range, however, occurs with measurements between the first and fourth partials that produces a beat rate that varies from 0 to about 1.3 beats per second. Although this range based on fourth partials varies slightly from piano to piano, the range of beat frequencies consistently lies within limited narrow range. This constancy indicates that the best tuning would occur using double octave tuning. Double octave tuning can be stated mathematically as:

$$Y(4,N)=Y(1,N+24) \quad (4)$$

where Y(4,N) is the cents deviation for the fourth partial of a root note N and Y(1,N+24) is the cents deviation of the first partial of the note two octaves above root note N. Double octave tuning means at the upper end of the piano the fundamental partial of C8 tunes to the fourth partial of C6. At the low end of the piano the fourth partial of A0 could be tuned to the fundamental partial of A2. In this range, however, the fourth partials are weak while the sixth partials are stronger. The sixth partial of A0 is E3, or N32.

Accordingly, it is possible to develop a tuning frequency for each note in the piano (i.e, each of notes N1 through N88) limiting the required note inharmonicities to the notes between notes N32 and N64, less than three octaves. As previously indicated, the assumptions of equation (1) seems to hold over as many as five octaves, so restricting the assumption to slightly less than three octaves in the middle of that range makes the assumption more accurate. More specifically, $$F=\sqrt[\frac{8}{3}]{\frac{B(64)}{B(32)}} \quad (5)$$

where B(32) and B(64) represent the inharmonicities of E3 and C6, respectively. For purposes of facilitating a tuner's ability to recall the specific notes, it has also been proposed to substitute F3 for E3 so that the tuner can remember the notes through the mnemonic "F-A-C-e". In that case equation (5) becomes:

$$F=\sqrt[\frac{31}{12}]{\frac{B(64)}{B(33)}} \quad (6)$$

The measurement of the inharmonicities of F3 and C6 provide the most accurate measurement of the slope and end points of this important portion of the inharmonicity straight line curve. In effect these measurements define a straight line having a slope through their respective end points thereby to define a curve having the general equation:

$$y=ax+b \quad (7)$$

The measurement of A4 then repositions the curve so that the measurement of the fourth partial of A4 and the tuning of A4 to its fourth partial will locate the fundamental frequency at 440 Hz therefor redefining equation (7) to the general form:

$$y=ax+b' \quad (8)$$

where b' indicates a new intercept for the curve of equation (6) so that the first partial of A4 will be 440 Hz even when A4 is tuned by its fourth partial.

If a piano is to be tuned with A4 as the standard note for being tuned to a "standard" frequency, equation (1) becomes:

$$B(N) = B(49)F^{\frac{N-49}{12}} \quad (9)$$

where B(49) is the measured inharmonicity of A4.

The inharmonicity I(p,N) of any partial of a given note N is a function of the inharmonicity factor B(N) and the partial number "p" and is given by:

$$I(p,N)=p^2B(N) \quad (10)$$

Combining equations (6), (9) and (10) using A4, or note N49, as the standard note yields the following:

$$Y(p,N) = \frac{15}{F^2-1}[B(N) - B(49)] + (p^2-1)B(N) \quad (11)$$

where Y(p,N) is the deviation of the frequency of the "p" partial of note N and F represents the measured inharmonicity variation of the range.

FIG. 1 represents the solutions of equation (11) for the first (p=1), second (p=2), fourth (p=4) and sixth (p=6) partials. Each solution produces a curve that varies smoothly without any discontinuities. Moreover, the different curves are interrelated. Consequently, the fundamental or first partial of each note will be at the same frequency independently of the selected order partial at which tuning occurs. For example, the frequency of the first partial of A4 will be 440 Hz regardless of whether it is tuned to the first, second, fourth or sixth partial. This characteristic enables one to select a strong partial for each note without introducing any discontinuities into the tuning. It has been found, however, that the strongest partials tend to remain the same over a range of contiguous notes. In the low octaves, for example, the sixth partial is prevalent Consequently, notes N0 through N27 can be tuned best by solving equation (11) for the sixth partial. The fourth partial is the strongest over the range from note N28 through note N51; the second partial, over the range from note N52 through N63; and the first partial from note N64 through note N88. Consequently, equation (11) defines the frequencies corresponding to the deviations shown in FIG. 1 for the designated partials for different ranges. For example, note N13 is tuned to the sixth partial that, in FIG. 1, is about four cents sharp. Note N49 (i.e., A4) is tuned to the fourth partial that, in FIG. 1, is about ten cents sharp.

Equation (11) provides a tuning curve in which double octaves have no "stretch". That is, playing double octaves on the tuned piano will not produce any beats between the fourth partial of the lower note and the first partial of the upper note in the double octave. They are exactly in tune. Many tuners continue to feel that the tuning is improved if there is a slight stretching of the double octaves. In accordance with another aspect of this invention, equation (11) can be modified to introduce such stretch. Specifically:

$$Y'(p,N)=Y(p,N)+Y_b(N) \quad (12)$$

where Y'(p,N) is the deviation for obtaining a stretched octave and $Y_b(N)$ is additive term given by:

$$Y_b(N) = \frac{4}{3} a(1 - 2^{\frac{49-N}{12}}) \quad (13)$$

where "a" is a beat adjusting factor that equals 1 to obtain one beat per second when playing a double octave, 0.5 to obtain one-half beat per second, etc.

Figure 2:
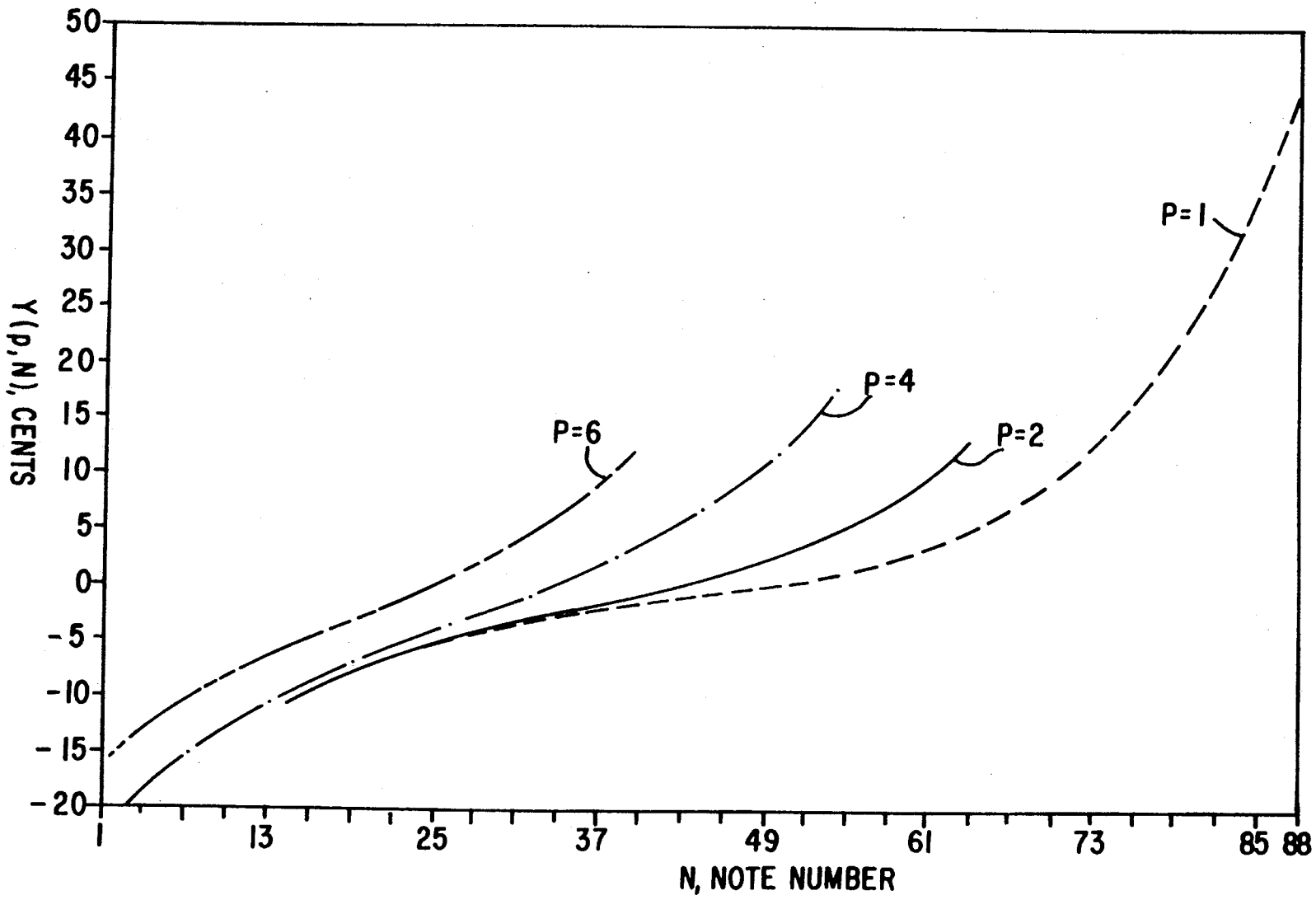
FIG. 2 is another graphical analysis of a musical instrument tuned in accordance with this invention.

FIG. 2 represents the solutions of equation (12) for the first (p=1), second (p=2), fourth (p=4) and sixth (p=6) partials that introduce one beat per second into each double octave. As with FIG. 1, each solution produces a curve that varies smoothly without any discontinuities and the different curves are interrelated. Consequently, as with FIG. 1, the fundamental or first partial of each note will be at the same frequency independently of the selected order partial at which tuning occurs. Equation (12) defines the frequencies corresponding to the deviations shown in FIG. 2 for the same partials for different ranges as shown in FIG. 1. However, the magnitude of the deviation is different. For example, note N13 is tuned to the sixth partial that, in FIG. 1, is about four cents sharp and, in FIG. 2, is about ten cents flat. Note N49 (i.e., A4) is tuned to the fourth partial that, in FIG. 1, is about ten cents sharp and remains at that same ten cents sharp position in FIG. 2 so that the first partial of A4 remains at 440 Hz.

Figure 3:
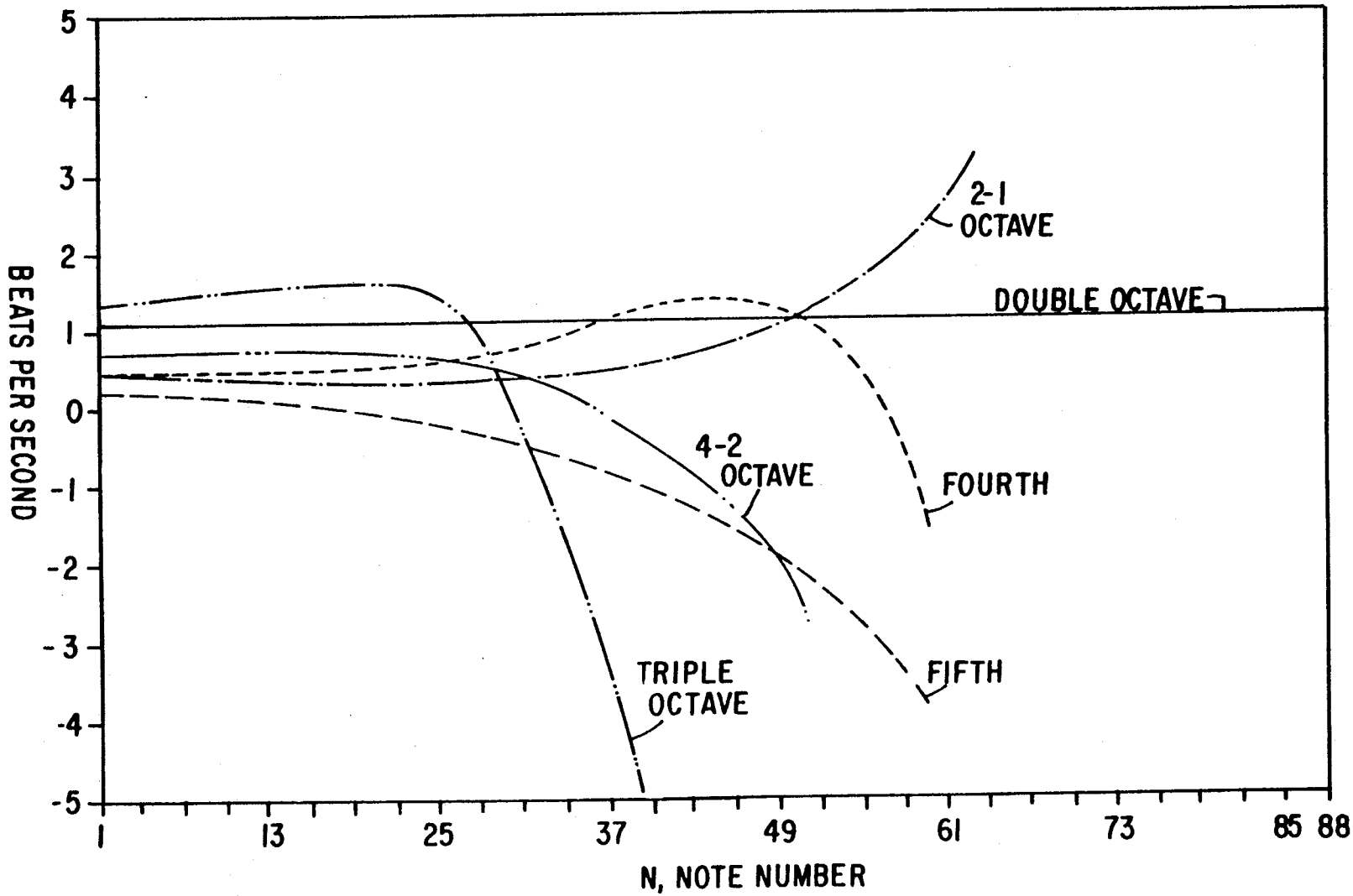
FIG. 3 is another graphical analysis of a musical instrument tuned in accordance with this invention.

FIG. 3 depicts a series of graphs that illustrates the different beat frequencies that exist for other intervals for a piano tuned according to equation (12). A DOUBLE OCTAVE curve shows a constant one-beat per second frequency between the fourth partial of the lower note of a double octave and the first partial of the upper note of the octave across the entire range of the piano. Beat frequency measurements for a 2:1 octave depicted in 2-1 OCTAVE curve exhibit a constant one-half beat per second frequency that begins to rise at about note N40 and continues to increase over the remaining range of the piano. The other depicted intervals shown as the FOURTH, FIFTH, 4-2 OCTAVE and TRIPLE OCTAVE curves all are variable with an eventual increase in the beat frequency in negative direction indicating the upper note in the interval is flat with respect to the lower note. However, it will also be apparent that none of these curves exhibits any discontinuities. It is the smoothness and consistent shape of all the partial curves resulting from the solutions that equation (11) and equation (13) provide that produces an improved tonal quality for the instrument as a whole.

Figure 4:
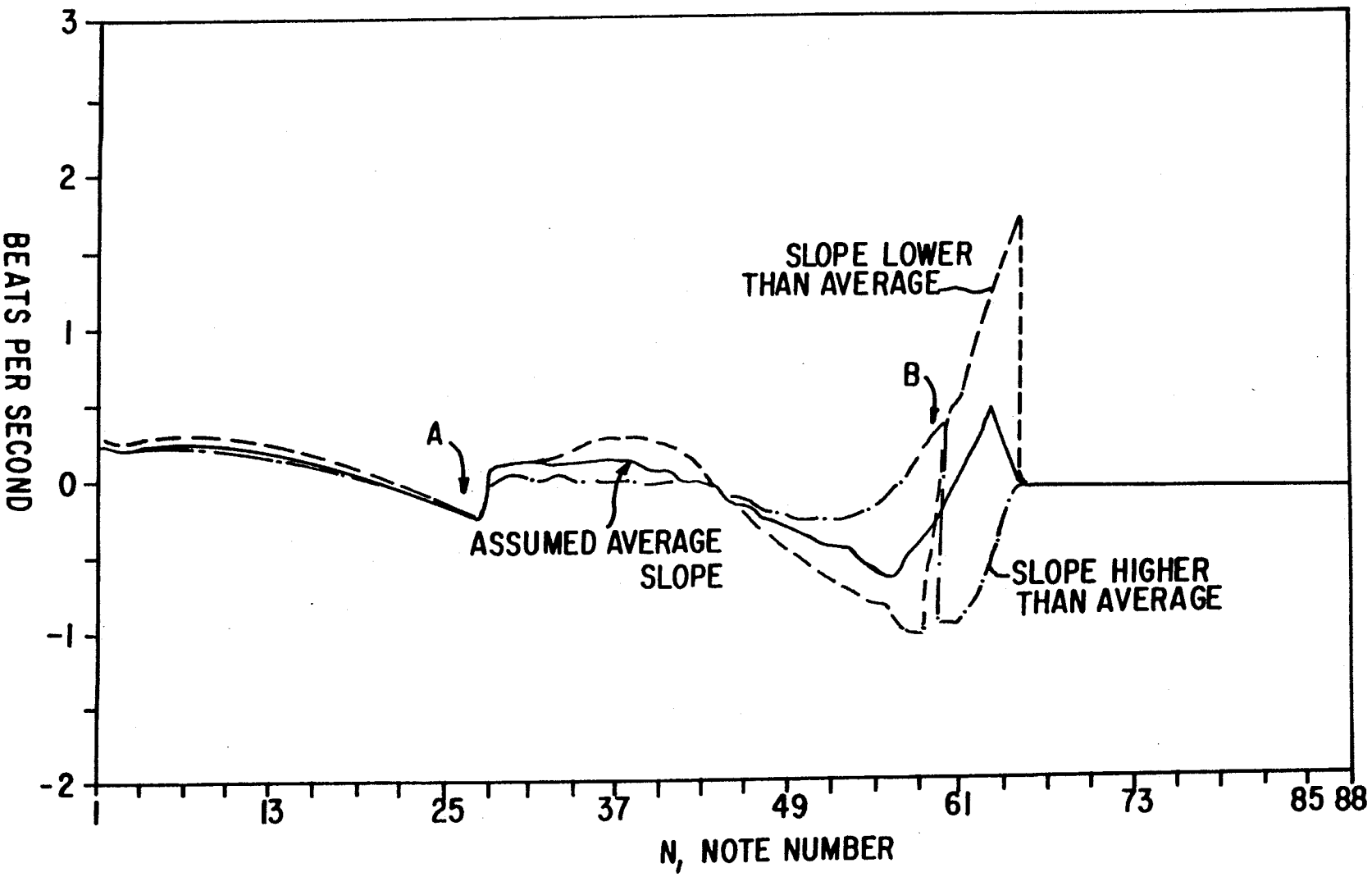
FIG. 4 is another graphical analysis of a musical instrument tuned in accordance with this invention.

FIG. 4 shows a tuning deviation measured in cents between the prior art tuning method that assumes a constant slope according to equation (1) and the tuning curves obtained with this invention. Two major discontinuities exist in the prior art tuning method. A first discontinuity at A occurs between notes N27 and N28 and the second, at B, occurs between notes N57 and N58. The assumption that the slope is constant for all pianos produces these discontinuities. The other deviation is due to the use of single octave tuning rather than double octave tuning.

From the foregoing analysis, it will be apparent that tuning in accordance with equation (11) or (12) or variations of those equations produce tuning curves that are smooth and have no discontinuities. Moreover, the measurement of the inharmonicity at a standard note, such as A4, allows this smooth continuous tuning to occur while the fundamental frequency from the standard note is at the corresponding standard frequency.

Figure 5:
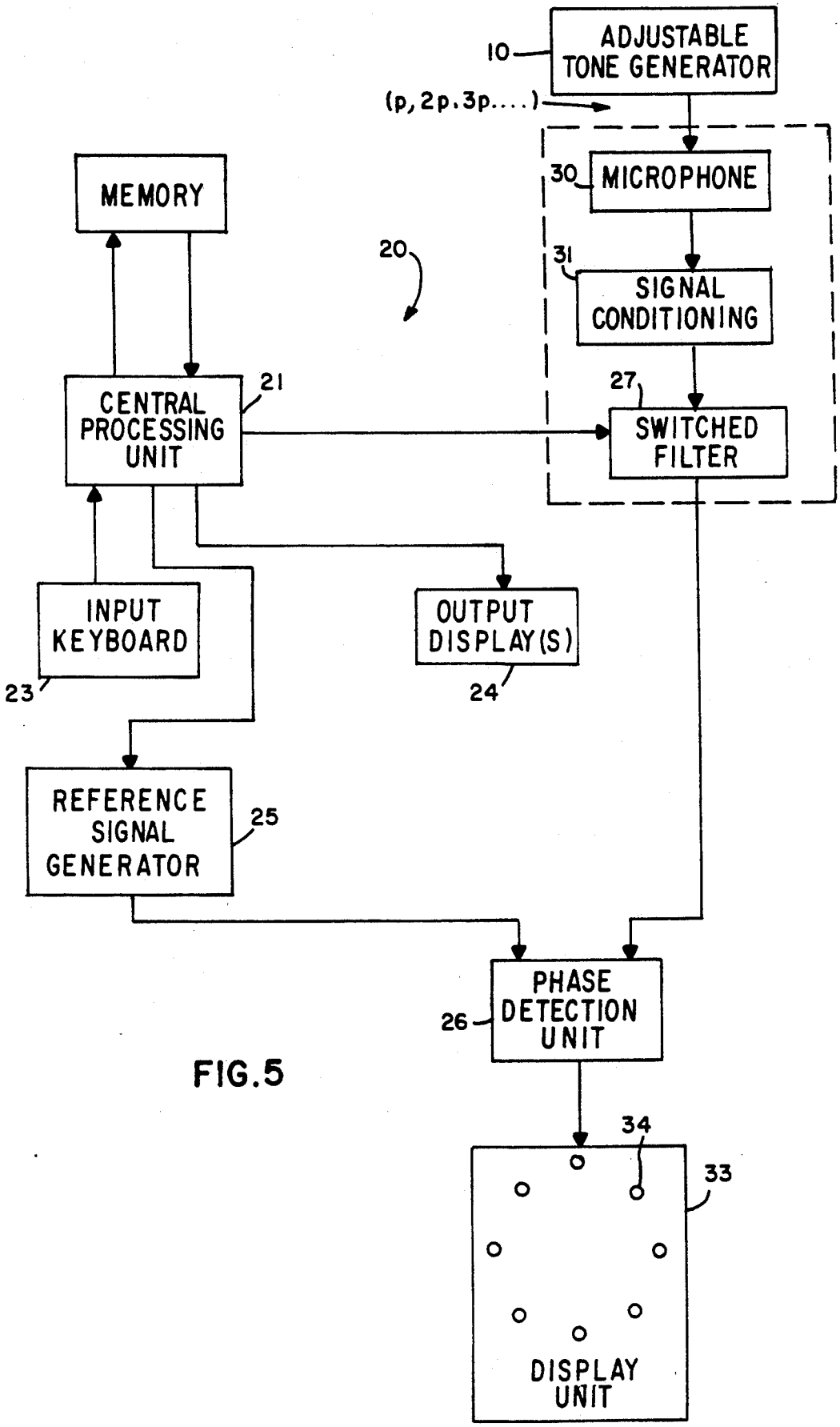
FIG. 5 is a block diagram of a tuning instrument that is useful in this invention.

FIG. 5 depicts an adjustable tone generator 10 for a given note N that produces first partial (p=1) and a plurality of higher order partials (p=2, p=3, p=4, . . . ). A piano string is an example of such a tone generator and a piano will have between one and three such tone generators, or strings, for each of note N1 through N88.

FIG. 5 also depicts tuning apparatus 20 that is useful in practicing this invention. The basic components of this apparatus are included in a Sanderson Accu-Tuner supplied by Inventronics, Inc. of Chelmsford, Mass. This apparatus 20 includes a central processing unit 21 with a memory 22, an input keyboard 23 and output displays 24. The input keyboard 23 enables a tuner to define a particular note and a cents deviation for that note manually or to establish operating parameters for the system. Whether by manual input or program response, the central processing unit 21 controls the frequency of a reference signal generator 25 to establish a reference frequency for a selected note and partial that constitutes one input to a phase detection circuit 26. The central processing unit 21 also controls a switched filter 27 to select a particular frequency band corresponding to the selected note and partial.

A microphone 30 receives the output from the tone generator 10 and produces an output signal that a signal conditioning unit 31 delivers to the switched filter 27. Only frequencies in the selected band can pass from the switch filter 27 to the phase detection unit 26.

The phase detection circuit 26 energizes an analog display unit 33 that contains a plurality of light-emitting diodes 34 arranged in a circular pattern. The display unit 33 produces a rotating display when a frequency difference exists between the signals from the reference signal generator 25 and a switch filter 27 and a stationary display when the two signals are at the same frequency.

The apparatus in FIG. 5 also contains the capability of storing the tuning frequencies for different pianos in discrete memory locations. In accordance with the prior art methods, a piano tuner would measure the inharmonicity of one note, namely F4 and store this measurement in the memory 22. Then the tuner used the input keyboard 23 to load the tuning frequencies for 42 notes (i.e., C3 to F6) into corresponding locations in the memory 22. Each location identified the piano being tuned, the note and octave of the note being tuned, the note and octave of the partial being used for the tuning process and the cents deviation of that partial. Corresponding information for the remaining 46 notes of the piano can be stored manually as the these notes are tuned manually.

It is possible to program a conventional personal computer or similar central processor unit to receive the measurements of the different notes, then to calculate and store in a predetermined location, for each note, the information concerning the tuning frequency of each note plus the deviation and partial order of each note to be tuned. However, such personal computers and the like that can compute equations (11) and (13) are not compatible with the apparatus of FIG. 1. Specifically the apparatus of FIG. 1 is adapted to be light weight, portable and to be operated for long intervals with low power battery thereby to reduce recharging times. The introduction of conventional computer circuitry would eliminate the ability to operate the system with low power and require recharging intervals during which the apparatus would not be available to the tuner. Moreover, the portability of the present apparatus would be reduced because the apparatus would be larger and heavier than the current apparatus.

Another alternative is to use a separate computer in which the piano tuner loads the inharmonicity measurements to produce a list that could be transferred electronically or manually into the memory 22. However, this requires a piano tuner to purchase additional hardware and software and to carry all this equipment to each location during a first visit. Consequently the cost and complexity of this alternative will not be attractive to the average piano tuner.

In order to overcome these problems there has been devised a modification of the apparatus shown in FIG. 5 for storing in the memory 22 a tuning curve for any given piano rapidly. Typically, for example, once measurements are taken, the modified tuning apparatus can produce and store a tuning curve for a given piano in ten seconds or so.

Figure 6:
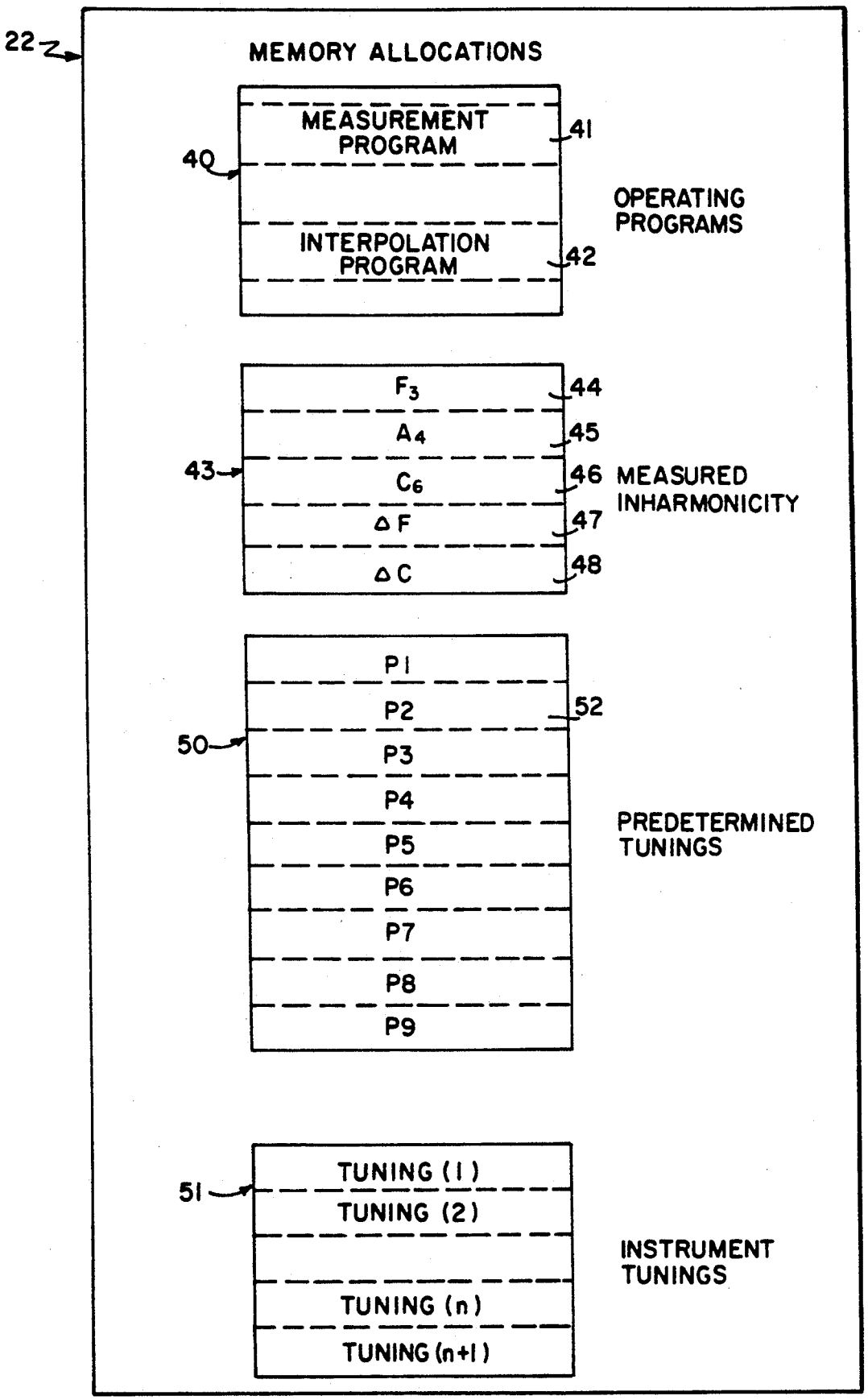
FIG. 6 depicts the allocations of locations in a memory shown in FIG. 5 that is useful in understanding this invention.

More specifically, FIG. 6 shows a modified memory 22 that includes a number of memory locations. For purposes of understanding this invention, the memory 22 is modified to included a block for storing operating programs 40 including a block for a measurement program 41 and another block for an interpolation program 42. Although described as logical blocks of contiguous locations, it will be apparent that the central processing unit 21 and its memory manager may allocate discrete noncontiguous locations for each of these and other storage locations within the memory 22. When the measurement program 41 operates, it produces stretch numbers based on the measured inharmonicities of particular notes and stores these stretch numbers at predetermined locations in the memory 22.

The measurement program 40 also produces a $\Delta F$ number stored in location 47 and a $\Delta C$ number stored in location 48. Another memory block 50 stores predetermined tunings that are obtained as described later. A block 51 stores the results of various instrument tunings for different pianos.

Referring to the predetermined tuning curve block 50, it is possible to define a number of predetermined tunings for different combinations of stretch numbers using equation (11) or equation (12). The apparatus uses the measured stretch numbers as basis for interpolating from the predetermined tunings in order to obtain the specific tuning curve for a particular piano or other musical instrument.

More specifically, the memory block 50 stores data for a series of tuning curves calculated for different combinations of inharmonicities. In a preferred embodiment, nine tuning curves, defined as tuning curves P1 through P9, are stored for inharmonicities in the form of stretch numbers $F_3$, $A_4$ and $C_6$, respectively, as follows:

| TUNING CURVES | | $C_6$ 4 | 8 | 12 |
|---|---|---|---|---|
| $F_3$ | 4 | P1 | P4 | P7 |
| | 11 | P2 | P5 | P8 |
| | 18 | P3 | P6 | P9 |

It is assumed that only one deviation of 8 cents for A4 (i.e., $A_{4=8}$) exists because its effect on the tuning is simply to multiply all the cents values by a normalizing number.

In accordance with this method, equation (11) or (12) is used to calculate for each combination of $F_3$ and $C_6$ to yield the nine tuning curves P1 through P9. P1 is the tuning curve that assumes the measured stretch number $F_3$ as four cents and the measured stretch number $C_6$ as four cents. P9 assumes $F_3=18$ and $C_6=12$. Other specific stretch numbers can be used to generate corresponding tuning curves. These particular values are selected because the ranges represent most of the tuning variations that occur in pianos based on the experience of measuring many pianos. Each section of a predetermined tuning block contains the calculated deviation and a partial for measuring that deviation for each of the 88 notes. For example, according to FIGS. 1 and 2, the location corresponding to note N1 will identify the sixth partial as the partial for measurement and the calculated deviation for the sixth partial. Thus each of the locations such as location 52 in FIG. 6 contains information concerning each note in the piano (i.e., notes 1 through 88) and each note position contains at least two elements, namely: (1) the partial number and the deviation number for the particular note.

Each of tuning curves P1 through P9 are installed permanently in the memory 22. Moreover, it also is assumed that each tuning curve has normalized values as follows:

| CURVE | $\Delta F$ | $\Delta C$ |
|---|---|---|
| P1 | −0.5 | −0.5 |
| P2 | −0.5 | 0 |
| P3 | −0.5 | +0.5 |
| P4 | 0 | −0.5 |
| P5 | 0 | 0 |
| P6 | 0 | +0.5 |
| P7 | +0.5 | −0.5 |
| P8 | +0.5 | 0 |
| P9 | +0.5 | +0.5 |

When a piano tuner initially tunes a piano for a first time, the tuner measures of the stretch numbers $F_3$, $A_4$ and $C_6$ and those numbers are stored in locations 44, 45 and 46. The interpolation program 42 begins by calculating two factors $\Delta F$ and $\Delta C$, according to the following equations:

$$\Delta F = \frac{4F_3}{7A_4} - \frac{11}{14} \tag{14}$$

$$\Delta C = \frac{C_6}{A_4} - 1 \tag{15}$$

Next the central processing unit interpolates to the second order for each given value of $\Delta F$ a value of three constants $QQ_N$, $RR$N and $SS_N$. Each is based upon data points for three possible predetermined tuning curves associated with different values of $\Delta C$ (i.e., $\Delta C=-0.5$, $\Delta C=0$ and $\Delta C=+0.5$) for each note (i.e., $1 \leqq N \leqq 88$). More specifically:

$$QQ_N=[2(P1_N-2P4_N+P7_N)\Delta F+(P7_N-P1_N)]\Delta F+P4_N \tag{16}$$

$$RR_N=[2(P2_N-2P5N+P8_N)\Delta F+(P8_N-P2_N)]\Delta F+P5_N \tag{17}$$

and $$SS_N=[2(P3_N-2P6_N+P9_N)\Delta F+(P9_n-P3N)]\Delta F+P6_N \tag{18}$$

Once the values of $QQ_n$, $RR_n$, and $SS_n$ are known, it is possible to perform a second order interpolation for the given value of $\Delta C$ to obtain a data point $TT_N$ as follows:

$$TT_N=[2(QQ_N-2RR_N+SS_N)\Delta C+(SS_N-QQ_N)]\Delta C+RR_N \quad (19)$$

Next for each data point $TT_N$ a specific value based upon the inharmonicity of the reference note A4 is calculated as follows:

$$CENTS_N = \frac{A_4}{8} TT_N \quad (20)$$

Thus each value of $CENTS_N$ is a data point on a tuning curve that can be stored in an instrument tuning memory location 51. Each location associated with the curve will identify a note, the deviation frequency for that note and the partial to be measured, as the partial information is obtained from each of the master tunings.

A piano tuner utilizes the input keyboard 23, output display 24 and display unit 23 to store the stretch numbers. Specifically the tuner strikes, for example, F3 and zeroes the display on the fourth partial. Then the tuner increments the tuning apparatus to monitor F6, three octaves above F3. When this occurs the lights on the display unit 33 rotate. The tuner then uses the input keyboard 23 to stop the display 34 and produces an output display of the cents difference between the actual fourth and eighth partials. This is $F_3$ that is stored by manipulation of the input keyboard 23 into location 44. This operation is repeated to store corresponding information for $A_4$ and $C_6$ in memory locations 45 and 46, respectively.

In actual practice the measurements can be made using the fourth and eighth partials of F3, the second and fourth partials of A4 and the first and second partials of C6. Further manipulation of the keyboard 23 then enables the central processing unit 21 to calculate a $CENTS_N$ value for each note in the piano and store those in succession in a specified tuning location of block 51.

When the calculation is completed the central processing unit 21 reads the first location in the memory block 51 for the stored tuning curve and obtains both the partial and the deviation for that partial. The central processor unit 21 sets the reference signal generator 25 and the switch filter 27 to enable the corresponding tone generator 10 to be tuned and to display the note to be tuned. Then the tuner adjusts the string until the lights 34 stop moving. Then tuning can be completed by merely incrementing through the remaining tone generators or strings on the piano.

Therefore in accordance with the apparatus and method of this invention, a musical instrument is tuned by measuring the inharmonicity of a plurality of notes. These measurements are the basis for calculating a specific tuning frequency for each curve according to particular formulas. In one specific embodiment a double interpolation program can be used in conjunction with predetermined tunings to establish a tuning frequency for each note in the musical instrument according to the measurements. If one of the measurements is of a standard note, then the reference can be set to the standard frequency.

This invention has been described in terms of its general theory and in terms of a specific embodiment. It will be apparent that a number of variations in connection with the apparatus for forming the structure or alternative methods for calculating the frequencies of each note can be substituted for those that are specifically disclosed with the attainment of some or all of the objects and advantages of this invention. Therefore, it is the object of the attached claims to cover all such variations and modifications as come within the true spirit and scope of this invention.

What is claimed as new and desired to be secured by Letters Patent of the United States is:

1. A method for tuning a musical instrument comprising a plurality of adjustable frequency tone generators for generating a plurality of musical notes, each tone generator producing a signal having a plurality of different order partials with the first partial for each tone generator corresponding to the lowest frequency produced thereby and including frequency adjustment means for adjusting the frequency thereof, said method comprising the steps of:

A. measuring the inharmonicity of each of at least a first and second tone generator by measuring the frequency of two partials produced by each of the tone generators, B. establishing a tuning curve determined by the measured inharmonicity of the tone generators thereby to establish a tuning frequency for each of the tone generators, and C. adjusting each tone generator to its corresponding tuning frequency.

2. A method as recited in claim 1 wherein the first tone generator produces a first partial at a standard frequency, said inharmonicity measuring step including the selection of the first tone generator and said establishment of said tuning curve including offsetting the tuning curve so the frequency of the first partial of the first tone generator corresponds to the standard frequency.

3. A method as recited in claim 2 wherein said measurement step includes measuring the inharmonicity of a third tone generator and wherein said tuning curve is established in response to the measured inharmonicities of the second and third tone generators, the inharmonicity of the first tone generator establishing the offset and the measured inharmonicities of the second and third tone generators establishing relative positions of the tuning frequencies of each of the tone generators.

4. A method as recited in claim 3 wherein the tuning frequency for each tone generator is determined in accordance with:

$$Y(p,N) = \frac{15}{F^2 - 1}[B(N) - B(STD)] + (p^2 - 1)B(N)$$

wherein Y(p,N) represents the frequency deviation as a percentage of a semitone, N is a note number, B(N) is the measured inharmonicity of the tone generator for note N, B(STD) is the measured inharmonicity for the tone generator for a standard note, and p is a partial number and F is slope factor given by:

$$F = \sqrt[\frac{(N_3-N_2)}{12}]{\frac{B(N_2)}{B(N_3)}}$$

wherein $B(N_2)$ and $B(N_3)$ represent the measured inharmonicities of the second and third tone generators.

5. A method as recited in claim 4 wherein the frequency of each tone generator is additionally modified according to:

$$Y'(p,N)=Y(p,N)+Y_b(N)$$

wherein $$Y_b(N)=\frac{4}{3}a(1-2^{\frac{49-N}{12}})$$

where "a" is a beat adjusting factor whereby tone generators having first partials two octaves apart produce a predetermined beat frequency when energized simultaneously.

6. In apparatus for tuning a musical instrument including a plurality of adjustable frequency tone generators each of which produces tones of different order partials with the first partial corresponding to the lowest frequency produced by the tone generator wherein said apparatus includes means for generating a measured frequency signal that corresponds to the frequency of a selected partial tone from a tone generator, means for generating a reference frequency signal for the tone generator and means for indicating deviation of the measured and reference frequency signals, the improvement of means in said reference frequency signal generating means including:

A. sensing means for recording the measured deviations of a plurality of the tone generators, B. means responsive to the measured deviations for determining the inharmonicity for the musical instrument for the plurality of tone generators, C. means responsive to the calculated change of inharmonicity over the plurality of tone generators for determining a corresponding tuning frequency for each tuning frequency, and D. output means responsive to said determinative means for generating the tuning frequency as the reference signal frequency for each tone generator.

* * * * *